US011294307B2

(12) United States Patent
Tanaka et al.

(10) Patent No.: US 11,294,307 B2
(45) Date of Patent: Apr. 5, 2022

(54) RECORDING MATERIAL COOLING DEVICE

(71) Applicant: CANON KABUSHIKI KAISHA, Tokyo (JP)

(72) Inventors: Kenichi Tanaka, Ibaraki (JP); Keita Kondo, Ibaraki (JP); Yuki Inoue, Ibaraki (JP); Shingo Katano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/160,062

(22) Filed: Jan. 27, 2021

(65) Prior Publication Data

US 2021/0240113 A1 Aug. 5, 2021

(30) Foreign Application Priority Data

Jan. 30, 2020 (JP) ..... JP2020-014115
Nov. 10, 2020 (JP) ..... JP2020-187428

(51) Int. Cl.
*G03G 15/20* (2006.01)

(52) U.S. Cl.
CPC ..... *G03G 15/2021* (2013.01); *G03G 15/2017* (2013.01); *G03G 15/2025* (2013.01)

(58) Field of Classification Search
CPC ..... G03G 15/2017; G03G 15/2021
See application file for complete search history.

(56) References Cited

U.S. PATENT DOCUMENTS 6,085,053 A * 7/2000 Saeki ..... G03G 15/754 399/165
6,185,394 B1 * 2/2001 Lee ..... G03G 15/754 399/116
6,249,662 B1 * 6/2001 Lee ..... G03G 15/754 399/165
8,655,242 B2 2/2014 Tanaka ..... 399/323
8,942,612 B2 1/2015 Tanaka ..... 399/330
9,069,299 B2 6/2015 Tanaka ..... G03G 15/2028
9,354,562 B2 5/2016 Tanaka ..... G03G 15/2028
9,389,554 B2 7/2016 Tanaka et al. ..... G03G 15/2021
9,465,336 B2 10/2016 Saito et al. ..... G03G 15/2053
9,547,262 B2 1/2017 Hirayama et al. . G03G 15/2039
(Continued)

FOREIGN PATENT DOCUMENTS

JP 2009-181055 8/2009
JP 2010-002644 1/2010
(Continued)

OTHER PUBLICATIONS

U.S. Appl. No. 17/160,071, filed Jan. 27, 2021.
U.S. Appl. No. 17/236,787, filed Apr. 21, 2021.

*Primary Examiner* — Carla J Therrien
(74) *Attorney, Agent, or Firm* — Venable LLP

(57) ABSTRACT

A recording material cooling device includes a belt; a cooling member, a first roller, a second roller, an urging member for urging a bearing portion so that the second roller moves toward an inner peripheral surface of the belt, a holding member, for holding the urging member, and a moving member for moving the holding member between a first position for enabling rotation of the belt by stretching said belt by the first roller and the second roller and a second position for facilitating exchange of the belt.

11 Claims, 9 Drawing Sheets

(56) References Cited

U.S. PATENT DOCUMENTS

| | | | | |
|---|---|---|---|---|
| 9,563,163 | B2 | 2/2017 | Tanaka et al. | G03G 15/502 |
| 10,061,242 | B2 | 8/2018 | Tanaka | G03G 15/2032 |
| 10,564,576 | B2 | 2/2020 | Tanaka et al. | G03G 15/2053 |
| 10,719,042 | B2 | 7/2020 | Hirayama et al. | G03G 15/2039 |
| 2012/0199443 | A1* | 8/2012 | Kaneyama | G03G 15/161 198/496 |
| 2013/0266352 | A1* | 10/2013 | Makino | G03G 15/2028 399/329 |
| 2014/0186080 | A1* | 7/2014 | Ikeda | G03G 15/6529 399/341 |
| 2017/0192387 | A1 | 7/2017 | Tanaka | G03G 15/2039 |
| 2017/0269548 | A1* | 9/2017 | Kutsuwada | G03G 21/206 |
| 2020/0363764 | A1 | 11/2020 | Inoue et al. | G03G 15/6555 |
| 2021/0072699 | A1 | 3/2021 | Inoue et al. | G03G 15/2017 |

FOREIGN PATENT DOCUMENTS

| | | |
|---|---|---|
| JP | 2015-094847 | 5/2015 |
| JP | 2017-173774 | 9/2017 |

* cited by examiner

RECORDING MATERIAL COOLING DEVICE

FIELD OF THE INVENTION AND RELATED ART

The present invention relates to an image forming a recording material cooling device, for cooling a recording material through a belt, suitable for use an image forming with apparatus, such as a printer, a copying machine, a facsimile machine or a multi-function machine, capable of forming an image by using an electrophotographic process.

In the image forming apparatus a toner image formed on a recording material such as paper is fixed on the recording material by being heated and pressed by a fixing device. Fixing of the toner image on the recording material is carried out by nipping and feeding the recording material by a fixing roller heated by a halogen heater or the like and by a pressing roller press-contacted to the fixing roller. When the toner image is fixed, the recording material is heated, and therefore, the recording material fed from the fixing device is liable to increase in temperature when compared with the recording material before fixing. Then, when the recording materials after the toner image is fixed are stacked on a stacking portion in a high-temperature state, there is a liability that the stacked recording materials stick to each other. In order to suppress such sticking of the recording materials, a recording material cooling device for lowering a temperature of the recording material after the fixing of the toner image is provided (Japanese Laid-Open Patent Application (JP-A) 2009-181055). The recording material cooling device disclosed in JP-A 2009-181055 is a device of a belt contact type, in which a belt for nipping and feeding the recording material fed from the fixing device is cooled by a heat sink, so that the temperature of the recording material is lowered through the belt.

In the case of the belt cooling type, an endless belt is stretched by a plurality of rollers in a stretched state, and the heat sink is contacted to an inner peripheral surface of the belt. In order to efficiently and reliably cool the belt, the heat sink is provided so as to contact the belt in area larger than contact areas of the respective rollers with the belt, and the belt contacts the heat sink in a state in which predetermined pressure is applied to the heat sink. Conventionally, during exchange of the belt by an operator, due to a slide of the belt on a heat sink and first belt stretching rollers, a sliding resistance exerted on the belt was large, so that it was difficult to exchange the belt.

SUMMARY OF THE INVENTION

The present invention has been accomplished in view of the above-described problem. A principal object of the present invention is to provide a recording material cooling device which is of a belt cooling type in which a heat sink is contacted to an inner peripheral surface of an endless belt in order to cool a recording material and which is capable of easily exchanging the belt by an operator.

According to an aspect of the present invention, there is provided a recording material cooling device for cooling a recording material passed through a fixing device for fixing a toner image on the recording material by heating, the recording material cooling device comprising: a belt; a cooling member configured to cool the belt in contact with an inner peripheral surface of the belt; a first roller provided on the inner peripheral surface of the belt; a second roller rotatably supported by a bearing portion and configured to stretch the belt in cooperation with the first roller; an urging member configured to urge the bearing portion so that the second roller moves toward the inner peripheral surface of the belt; a holding member configured to hold the urging member; and a moving member configured to move the holding member between a first position for enabling rotation of the belt by stretching said belt by the first roller and the second roller and a second position for facilitating exchange of the belt.

DESCRIPTION OF EMBODIMENTS

<Image Forming System>

In the following, a recording material cooling device of an embodiment will be described.

First, a general structure of an image forming apparatus with which the recording material cooling device of this embodiment is suitably used will be described with reference to FIGS. 1 and 2. An image forming apparatus 100 is an electrophotographic full-color printer of a tandem type. The image forming apparatus 100 includes image forming portions PY, PM, PC and PK for forming images of yellow, magenta, cyan and black, respectively. The image forming apparatus 100 forms a toner image on a recording material S in response to an image signal sent from an original reading device (not shown) connected to an apparatus main assembly 100A or from an external device such a personal computer communicatably connected to the apparatus main assembly 100A. As the recording material S, it is possible to use sheet materials of various kinds, such as sheets including plain paper, thick paper, roughened paper, uneven paper and coated paper; plastic films; and cloths.

Figure 1:
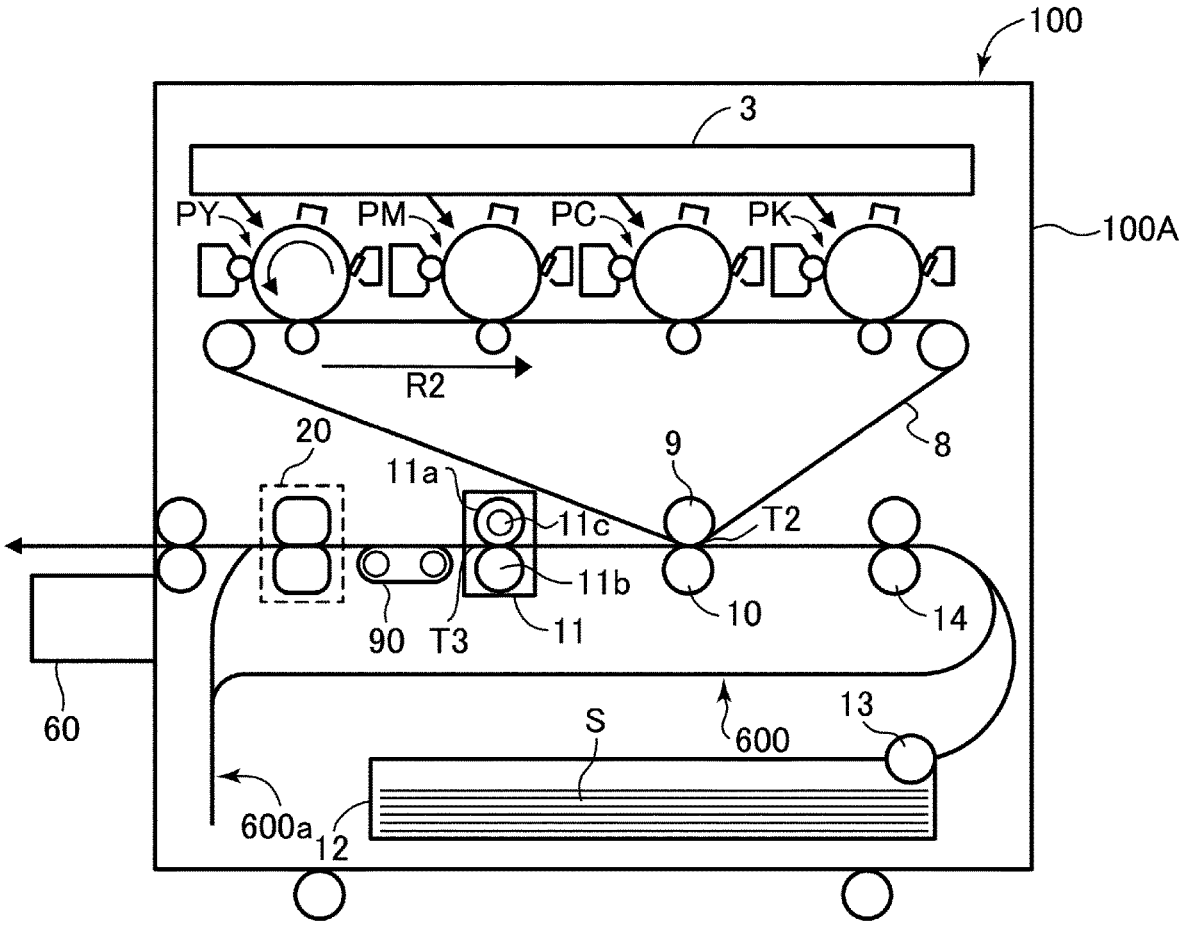
FIG. 1 is a schematic view showing a structure of an image forming apparatus according to a first embodiment of the present invention.

As shown in FIG. 1, the image forming portions PY, PM, PC and PK are juxtaposed along a movement direction of the intermediary transfer belt 8 in the apparatus main assembly 100A. The intermediary transfer belt 8 is constituted so as to be stretched by the plurality of rollers and to be moved (rotated) in an arrow R2 direction in the figure. The intermediary transfer belt 8 carries and feeds primary-transferred toner images. At a position opposing, through the intermediary transfer belt 8, a roller 9 stretching the intermediary transfer belt 8, a secondary transfer roller 10 is disposed, so that a secondary transfer portion T2 where the toner images on the intermediary transfer belt 8 are transferred onto the recording material S is formed. On a side downstream of the secondary transfer portion T2 with respect to a recording material feeding direction, a fixing device 11 is provided. Further, on a side downstream of the fixing device 11 with respect to the recording material feeding direction, a device 90 and a recording material cooling device 20 are provided in a named order from an upstream side.

At a lower portion of the image forming apparatus 100, a cassette 12 in which recording materials S are accommodated. The recording material S is fed from the cassette 12 toward a registration roller pair 14 by a feeding roller 13 along a feeding passage 600 forming a path of the recording material S in the apparatus main assembly 100A. Thereafter, the registration roller pair 14 is started to be rotated in synchronism with the toner images formed on the intermediary transfer belt 8, so that the recording material S is fed toward the secondary transfer portion T2 along the feeding passage 600.

Incidentally, in this embodiment, only one cassette 12 is shown, but a plurality of cassettes 12 capable of accommodating the recording materials different in size and thickness may also be provided, and in that case, the recording material S is selectively fed from either one of the plurality of cassettes 12 to the feeding passage 600. Further, the recording material S is not limited to the recording material S accommodated in the cassette 12, but the recording material S stacked on a manual feeding portion (not shown) may also be fed to the feeding passage 600.

[Image Forming Portion]

The four image forming portions PY, PM, PC and PK included in the image forming apparatus 100 have the substantially same constitution except that development colors are different from each other. Accordingly, in this embodiment, as a representative, the image forming portion PK will be described, and other image forming portions PY, PM and PC will be omitted from description.

Figure 2:
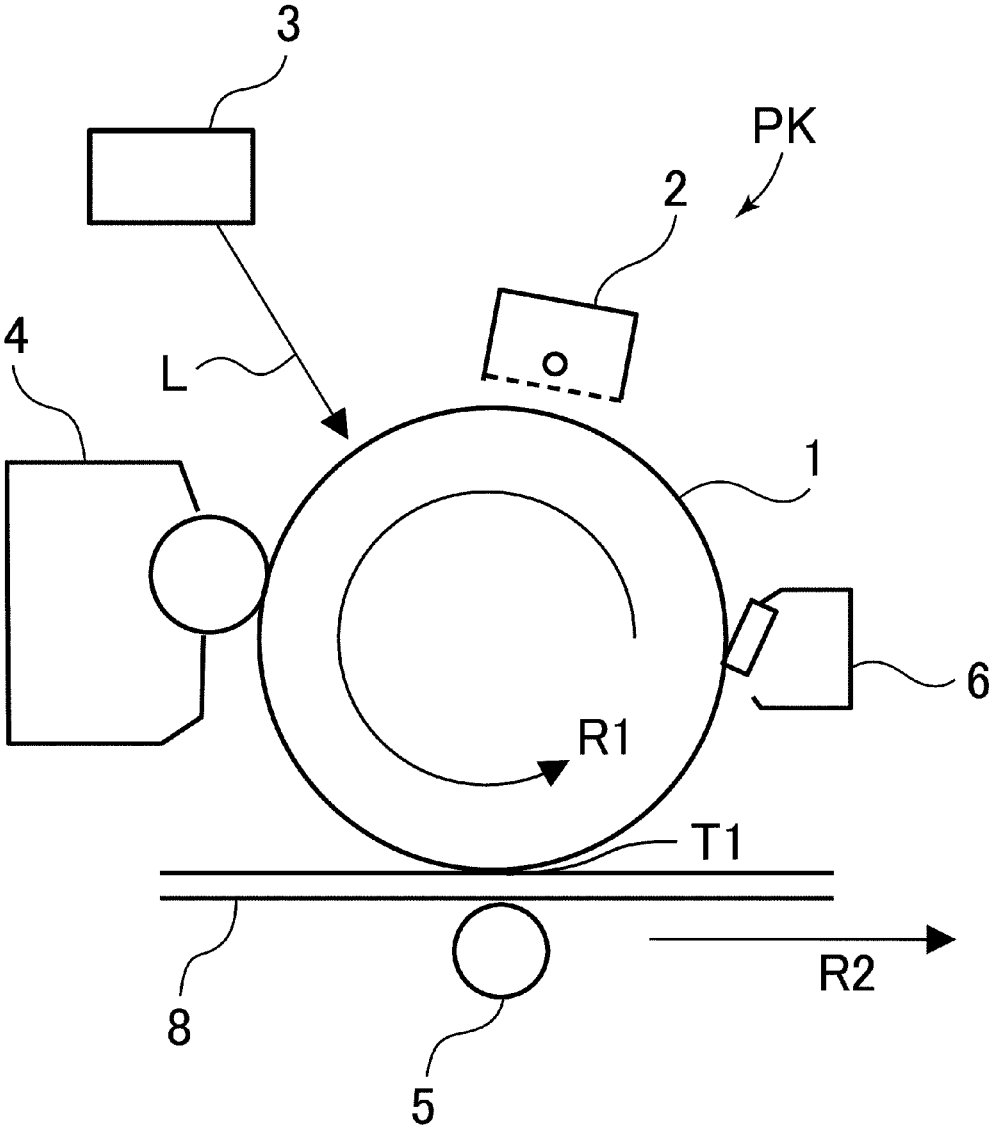
FIG. 2 is a schematic view showing an image forming portion.

As shown in FIG. 2, in the image forming portion PK, a cylindrical photosensitive drum 1 is provided as a photosensitive member. The photosensitive drum 1 is rotationally driven in an arrow R1 direction in the figure. At a periphery of the photosensitive drum 1, a charging device 2, an exposure device 3, a developing device 4, a primary transfer roller 5 and a drum cleaning device 6 are provided.

A process for forming, for example, a full-color image by the image forming apparatus 100 will be described. First, when an image forming operation is started, a surface of the rotating photosensitive drum 1 is electrically charged uniformly by the charging device 2. The charging device 2 is a corona charger or the like for charging the photosensitive drum 1 to a uniform negative dark-portion potential by irradiating the photosensitive drum 1 with charge particles with corona discharge, for example. Then, the photosensitive drum 1 is subjected to scanning exposure to laser light L which is emitted from the exposure device 3 and which corresponds to an image signal. By this, an electrostatic latent image depending on the image signal is formed on the surface of the photosensitive drum 1. The electrostatic latent image formed on the photosensitive drum 1 is visualized (developed) into a visible image by toner (developer) accommodated in the developing device 4.

The resultant toner image formed on the photosensitive drum 1 is primary-transferred onto the intermediary transfer belt 8 at a primary transfer portion T1 formed between the intermediary transfer belt 8 and the photosensitive drum 1 opposing the primary transfer roller 5. At this time, to the primary transfer roller 5, a primary transfer bias (voltage) is applied. After the primary transfer, toner remaining on the surface of the photosensitive drum 1 is removed by the drum cleaning device 6.

Returning to FIG. 1, the above-described operation is sequentially performed in the image forming portions PY, PM, PC and PK for yellow, magenta, cyan and black, respectively, so that four color toner images are superposed on the intermediary transfer belt 8. Thereafter, in synchronism with toner image forming timings, the recording material S accommodated in the cassette 12 is fed to the secondary transfer portion T2. Then, by applying a secondary transfer bias (voltage) to the secondary transfer roller 10, the toner images for a full-color image are collectively secondary-transferred onto the recording material S.

Then, the recording material S is fed toward the fixing device 11. The fixing device 11 includes a fixing roller 11*a* provided rotatably and a pressing roller 11*b* rotating while being press-contacted to the fixing roller 11*a*. In a state in which the pressing roller 11*b* is press-contacted to the fixing roller 11*a* (for example, about 784 N (about 80 kgf) in press-contact force), the fixing roller 11*a* is rotated at a predetermined rotational speed (for example, 400 mm/sec) by an unshown driving motor. Inside the fixing roller 11*a*, a halogen heater 11*c* is provided, and by the halogen heater, a surface temperature of the fixing roller 11*a* is increased (for example, 180° C.), so that the fixing device 11 is capable of heating the recording material S.

Figure 3:
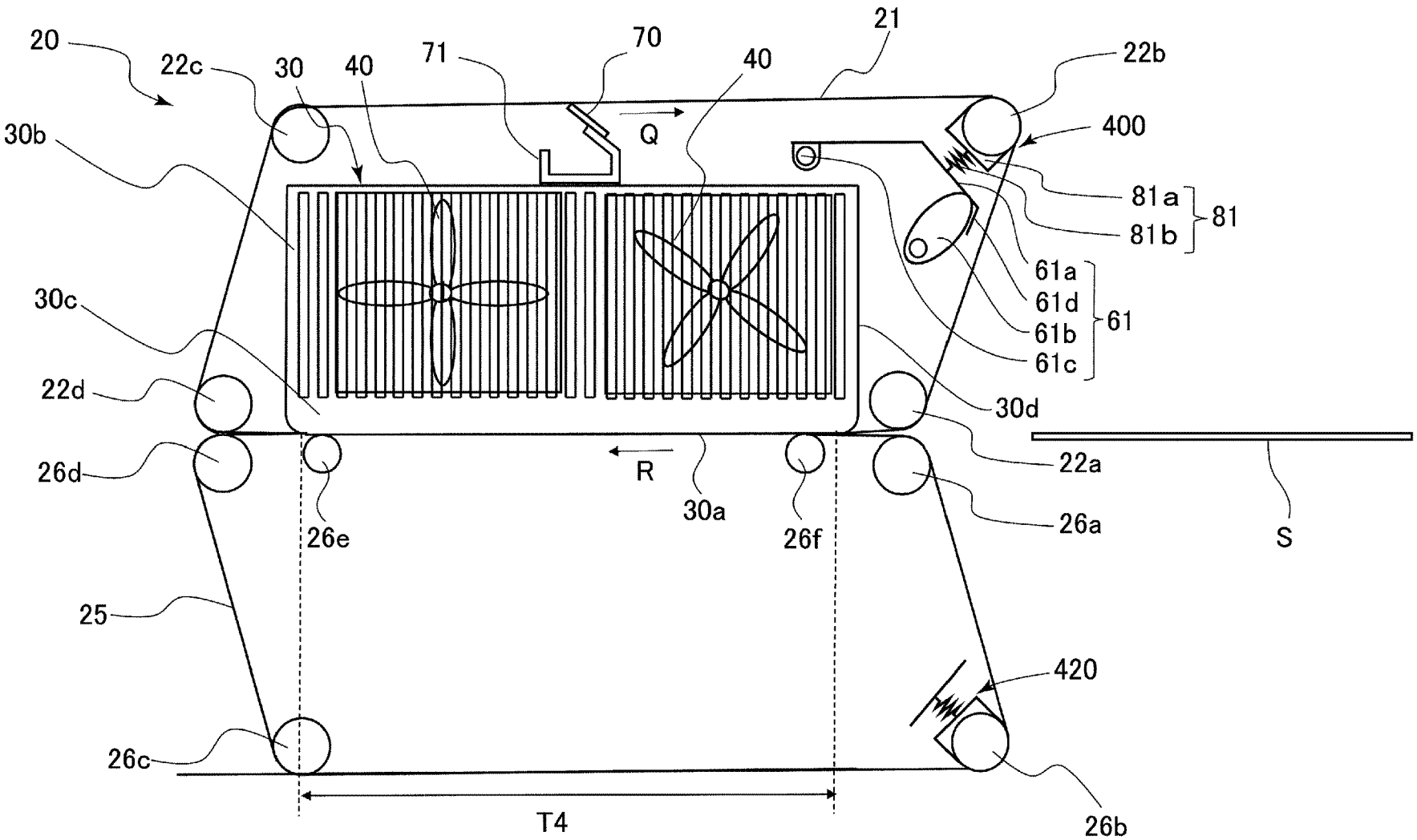
FIG. 3 is a schematic view showing a recording material cooling device of the first embodiment.
Figure 4:
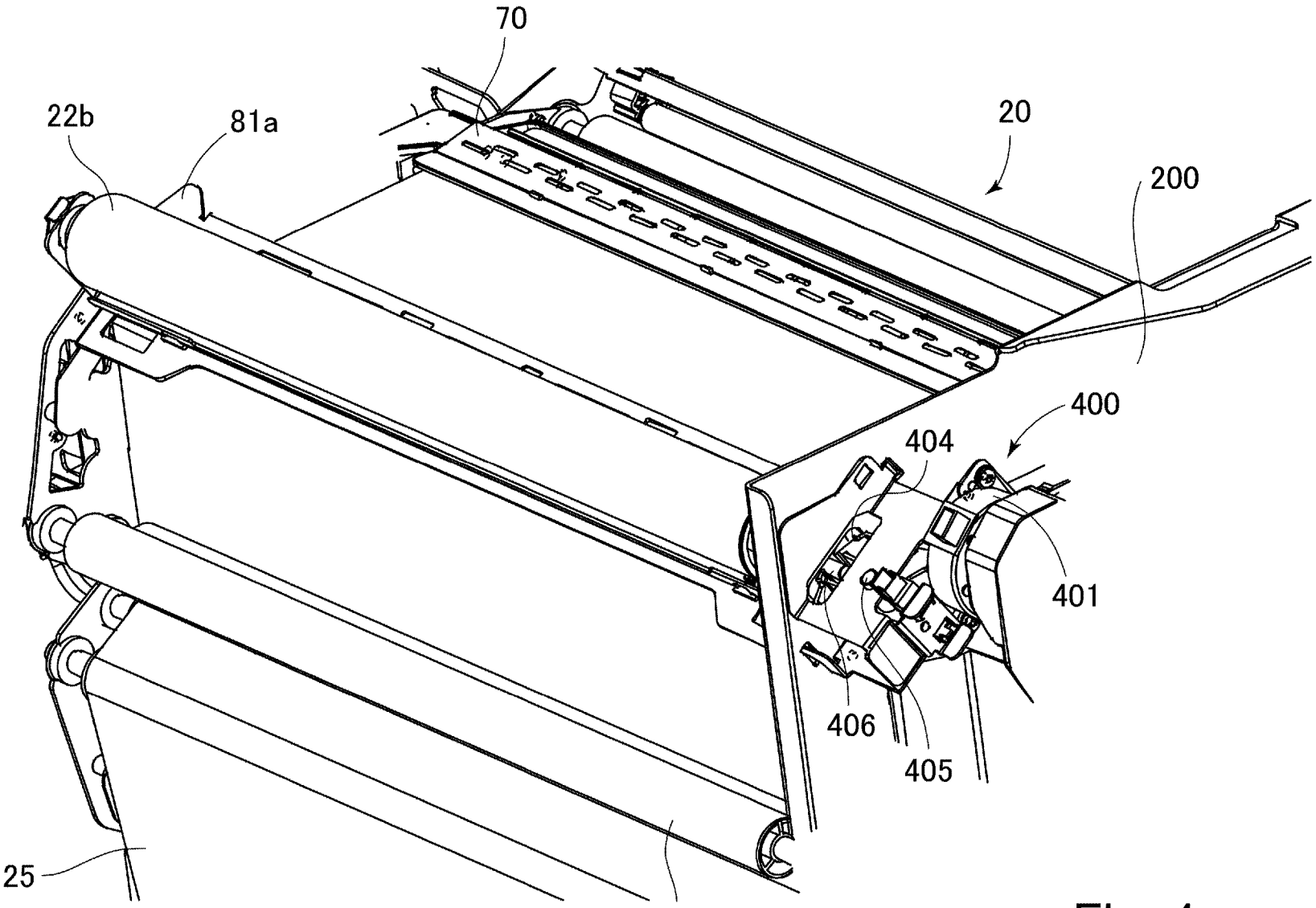
FIG. 4 is a perspective view of the recording material cooling device as seen from a back surface side of the recording material cooling device.

At a fixing nip T3 formed by the fixing roller 11*a* and the pressing roller 11*b*, the fixing device 11 nips and feeds the recording material S on which the full-color toner image is formed and thus heats and presses the fed recording material S, so that the full-color toner image is fixed on the recording material S. That is, the toners of the full-color toner image formed on the recording material S are melted and mixed by heating and pressing, and are fixed as a full-color image on the recording material S. Thus, a series of operations of the image forming process is ended. Then, the recording material S on which the toner image is fixed is fed toward the recording material cooling device 20 by the feeding device 90. The feeding device 90 feeds the recording material S from the fixing device 11 to the recording material cooling device 20 by rotating a belt, for carrying the recording material S through, for example, air suction or the like, at a predetermined rotational speed (for example, 400 mm/s). The recording material cooling device 20 cools the recording material S fed by the feeding device 90. A temperature of the recording material S is, for example, about 90° C. before being cooled by the recording material cooling device 20, but is lowered to about 60° C. by the recording material cooling device 20. The recording material cooling device 20 will be described later (FIG. 3 to FIG. 4B).

Incidentally, in the case of this embodiment, the feeding passage 600 includes a reverse feeding portion 600*a* in which for the purpose of double-side printing, the recording material S cooled by the recording material cooling device 20 is turned upside down and then is fed again to the image forming portions PY, PM, PC and PK. That is, in the case of one-side printing, the recording material S on which first surface (front surface) the toner image is fixed is cooled by the recording material cooling device 20 and thereafter is discharged to an outside of the image forming apparatus 100 and is stacked on a stacking unit 60. On the other hand, in the case of the double-side printing, the recording material S on which first surface (front surface) the image is fixed is cooled by the recording material cooling device 20, and thereafter is turned upside down by the reverse feeding portion 600*a*. Then, the recording material S is fed along the feeding passage 600, and thereafter, the toner image is formed and fixed on a second surface (back surface). The recording material S on which second surface the toner image is fixed is cooled by the recording material cooling device 20, and thereafter is discharged to the outside of the image forming apparatus 100, so that the recording material S is stacked on the stacking unit 60.

<Recording Material Cooling Device>

Next, the recording material cooling device 20 of this embodiment will be described using FIG. 3 to FIG. 8. The recording material cooling device 20 of this embodiment is a cooling device of a belt cooling type. As shown in FIG. 3, the recording material cooling device 20 includes an endless first belt 21 and endless second belt 25 for nipping and feeding the recording material S in cooperation with the first belt 21. Each of the first belt 21 and the second belt 25 is an endless belt which is formed of a polyimide resin material high in strength so as to have a thickness of 100 μm and a peripheral length of 942 mm, for example.

As shown in FIG. 3, the first belt 21 is stretched by first belt stretching rollers 22*a* to 22*d*, and at least one of the first belt stretching rollers 22*a* to 22*d* is rotated by an unshown driving motor. In the case of this embodiment, for example, the roller 22*d* is rotated by the unshown driving motor, so that the first belt 21 is moved in an arrow Q direction in the figure. The roller 22*d* as a driving roller includes, for example, a 1 mm-thick rubber layer as a surface layer, and is formed with an outer diameter of 40 mm, for example.

The roller 22*b* as a second roller is a steering roller which is provided so as to be capable of stretching the first belt in cooperation with the roller 22*c* as a first roller in contact with an inner peripheral surface of the first belt and which controls a shift of the first belt in a widthwise direction of the first belt (widthwise direction of the roller 22*c*). The roller 22*b* includes a 1 mm-thick rubber layer as a surface layer, and is capable of controlling meandering of the first belt by performing a steering operation for forming a rudder angle relative to the roller 22*c* as the first roller. The roller 22*b* is shaft-supported by a roller holder 81 so as to be rotatable and is subjected to the steering operation by a steering mechanism 400.

The steering mechanism 400 and the roller holder 81*a* will be described using FIGS. 4 and 5. FIG. 4 is a perspective view of the recording material cooling device 20 as seen from a rear (surface) side of the recording material cooling device 20. In FIG. 4, the first belt 21 is omitted from illustration. As shown in FIG. 4, the steering mechanism 400 is mounted on a rear (surface) plate 200 which is a supporting frame on the rear side of the recording material cooling device 20. The roller 22*b* and the steering mechanism 400 are disposed on an opposite side from each other so as to sandwich the rear plate 200. The rear plate 200 is provided with at least a through hole into which the steering operation shaft 406 is inserted. Thus, a drive conversion portion 410 including a fork plate 404 is capable of carrying out steering control of the roller 22*b* even in a state in which the drive conversion portion 410 is positioned on the opposite side from the roller 22*b* with respect to the rear plate 200.

Figure 5:
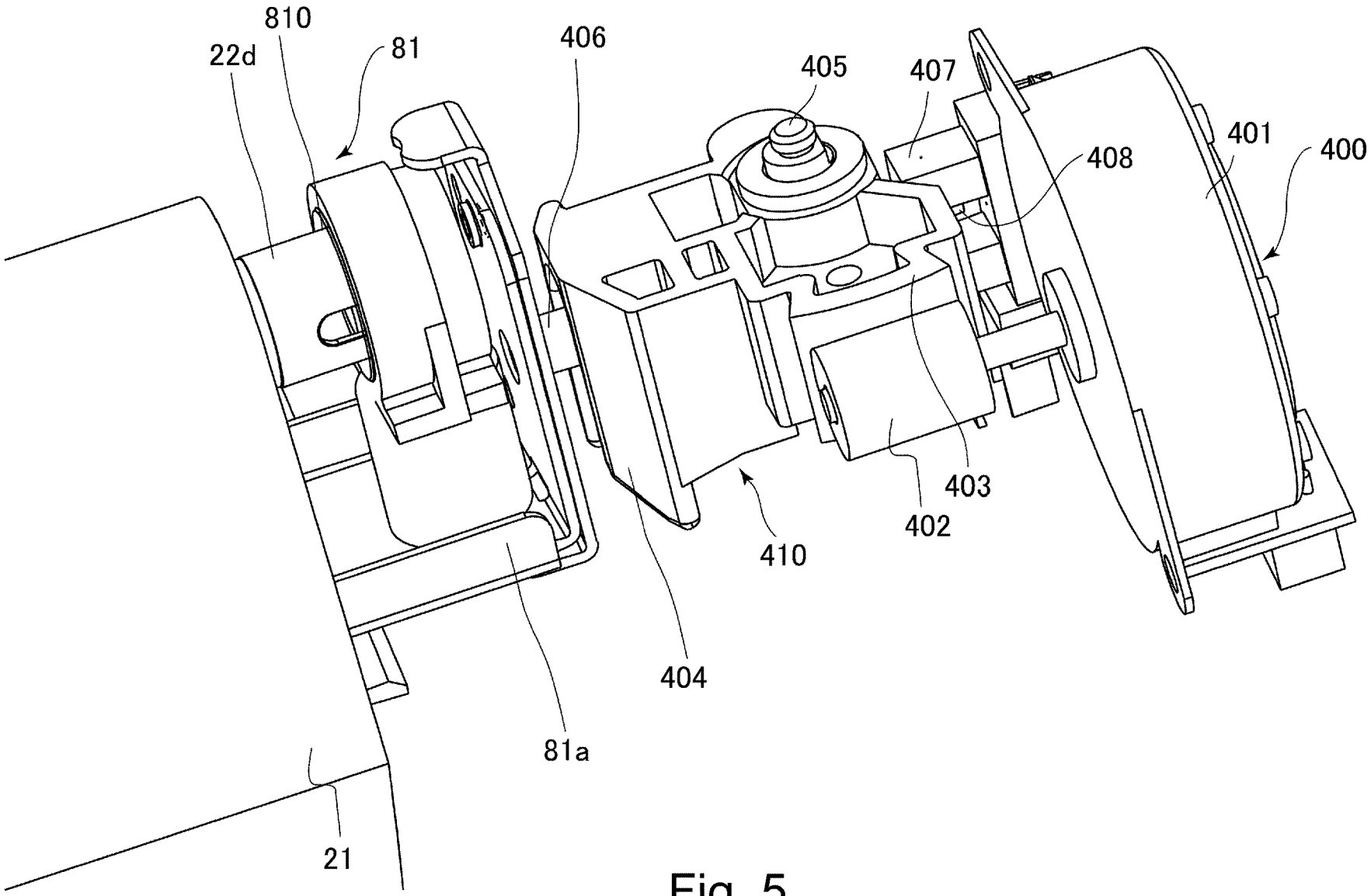
FIG. 5 is an enlarged perspective view for illustrating a steering mechanism.

The steering mechanism 400 includes, as shown in FIG. 5, a steering motor 401, a worm 402, the drive conversion portion 410, a rotatable shaft portion 405, the steering operation shaft 406, a position flag 408 and a position sensor 407. The steering motor 401 is a stepping motor and is rotatable at a predetermined number of rotations in an arbitrary direction of normal/reverse direction. When the steering motor 401 is rotated, the worm 402 mounted on a rotation shaft of the steering motor 401 is rotated.

Here, the drive conversion portion 410 integrally includes a worm wheel 403 and the fork plate 404. Rotation of the worm 402 is transmitted to the worm wheel 403 engaged with the worm 402. At this time, in accordance with rotation of the worm 402 with normal/reverse rotation of the steering motor 401, the worm wheel 403 is capable of being reciprocated in the rotational axis direction of the steering motor 401. Thus, through the worm 402 and the worm wheel 403, with rotation of the steering motor 401, the drive conversion portion 410 is capable of being rotated about a rotation shaft portion 405 as a rotation center. That is, drive of the steering motor 401 is transmitted to the drive conversion portion 410 through the worm wheel 403, so that the drive conversion portion 410 is capable of swinging about a rotational shaft portion 405 so that the fork plate 404 swings.

The steering mechanism 400 includes the position flag 408 movable with movement of the drive conversion portion 410 and the position sensor 407 for detecting the position of the drive conversion position through the position flag 408. Then, steering control depending on a detection result of the position sensor 407 is capable of being carried out.

The roller holder 81*a* is provided, as shown in FIG. 5, with a bearing portion 810 for shaft-supporting the rotation shaft of the roller 22*d* so as to be rotatable. Further, to the roller holder 81*a*, the steering operation shaft 406 engaged with the above-described drive conversion portion 410 is fixed. The steering operation shaft 406 is engaged with the fork plate 404 of the drive conversion portion 410 with a gap, so that the steering operation shaft 406 is capable of operating together with the drive conversion portion 410 with a swing of the fork plate 404. Thus, the steering operation shaft 406 operates with the swing of the fork plate 404, so that the roller holder 81*a* is swingable about a swing center shaft (not shown) crossing the rotational axis direction of the roller 22*b*. Then, the roller 22*b* supported by the roller holder 81*a* is also swung by following the swing of the roller holder 81*a*, so that a steering angle of the roller 22*b* can be adjusted. Thus, when the steering angle of the roller 22*b* is adjusted, the first belt 21 is reciprocated in the widthwise direction, so that steering control of the first belt 21 such that the first belt 21 is positioned within a predetermined range with respect to the widthwise direction can be realized.

Returning to FIG. 3, a roller supporting mechanism 81 includes the above-described roller holder 81*a* and a spring 81*b* as an urging means for urging the roller holder 81*a* toward the first belt 21. This spring 81*b* is spring pressure-fixed one capable of urging the roller 22*b* with an urging force such that tension of the first belt 21 is about 39.2 N (about 4 kgf).

On an inner peripheral surface side of the first belt 21, in addition to the above-described plurality of first stretching rollers 22*a* to 22*d* and the roller supporting mechanism 81, a heat sink 30, a scraper 70 and a belt stretching mechanism portion 61 are provided. The heat sink 30, the scraper 70 and the belt stretching mechanism portion 61 will be described later.

On the other hand, the second belt 25 as a rotatable member is stretched by a plurality of second belt stretching rollers 26*a* to 26*d* and is contacted to an outer peripheral surface of the first belt 21. The second belt 25 contacts the outer peripheral surface of the first belt 21 and forms a cooling nip T4 for cooling the recording material S, on which the toner image is formed, while feeding the recording material S. In the case of this embodiment, the roller 26*d* is pressed by the roller 22*d* at pressure of, for example, about 49 N (about 6 kgf). Further, the roller 26*d* is connected to a driving motor for driving the roller 22*d* through driving gears although the driving motor is omitted from illustration, and is rotated by this driving motor, so that the second belt 25 is moved in an arrow R direction. That is, the second belt 25 is moved (rotated) together with the first belt 21. The roller 26*b* is a steering roller for controlling a shift of the second belt 25 with respect to the widthwise direction (rotational axis direction of the roller 26*c*), and controls meandering of the second belt 25 by performing a steering operation for forming a rudder angle relative to the roller 26*c* at a widthwise central portion as a swing center. That is, the roller 26*b* is subjected to the steering operation by a steering mechanism 420 similar to the above-described steering mechanism 400.

On an inner peripheral surface side of the second belt 25, a plurality of pressing rollers are provided for pressing the second belt 25 toward the heat sink 30 which is provided on the inner peripheral surface side of the first belt 21 and which is described later. In this embodiment, as an example, with respect to a recording material feeding direction (the arrow direction in FIG. 3), a pressing roller 26*e* is provided on a downstream side of the cooling nip T4 and a pressing roller 26*f* is provided on an upstream side of the cooling nip T4. These pressing rollers 26*e* and 26*f* press the second belt 25 at pressure of, for example, 9.8 N (1 kgf), so that the first belt 21 is contacted to the heat sink 30 with reliability by the pressing rollers 26*e* and 26*f* through the second belt 25.

Incidentally, in this embodiment, the example in which both the first belt 21 and the second belt 25 are driven was described, but the present invention is not limited thereto. For example, only the first belt 21 is driven and the second belt 25 may also be driven by the first belt 21, or only the second belt 25 is driven and the first belt 21 may also be driven by the second belt 25.

<Heat Sink>

On the inner peripheral surface side of the first belt 21, the heat sink 30 for cooling the first belt 21 is provided. In the case of this embodiment, the heat sink 30 is contacted to the inner peripheral surface of the first belt 21 contacting the recording material S on a side where the toner image is fixed on the recording material S by the fixing device 11. That is, the recording material S on which the toner image is fixed is nipped by the first belt 21 and the second belt 25 and is fed in a recording material feeding direction (arrow R direction in the figure) in accordance with circulatory movement of these belts. During the feeding, the recording material S passes through the cooling nip T4 as a nip formed by contact between the first belt 21 and the second belt 25. In the case of this embodiment, in the cooling nip T4, the first belt 21 is cooled by the heat sink 30. In order to efficiently cool the recording material S, the heat sink 30 contacts the inner peripheral surface of the first belt 21 at a place where the cooling nip T4 is formed. When the recording material S passes through the cooling nip T4, the recording material S is lowered in temperature through the first belt 21 cooled by the heat sink 30.

The heat sink 30 as a cooling member is radiator (dissipator) plate formed of metal such as aluminum. The heat sink 30 includes a heat receiving portion 30*a* for taking heat from the first belt 21 in contact with the first belt 21, a heat radiating (dissipating) portion 30*b* for radiating (dissipating) heat, and a fin base 30*c* for transferring the heat from the heat receiving portion 30*a* to the heat radiating portion 30*b*. The heat radiating portion 30*b* is formed with many heat radiating fins in order to promote efficient radiation by increasing a contact area to the air. For example, the heat radiating fins are set at 1 mm in thickness, 100 mm in height and 5 mm in pitch, and the fin base 30*c* is set at 10 mm in thickness. Further, in order to forcedly cool the heat sink 30 itself, a cooling fan 40 sending the air toward the heat sink 30 (specifically the heat radiating portion 30*b*) is provided. An air flow rate of the cooling fan 40 is set at, for example, 2 $m^3$/min.

[Scraper]

Further, on the inner peripheral surface side of the first belt 21, the scraper 70 as a cleaning member is provided on a side downstream of the heat sink 30 with respect to the rotational direction (arrow Q direction in FIG. 3) of the first belt 21. In the case of this embodiment, the scraper 70 is provided downstream of the roller 22*c* and upstream of the roller 22*b* with respect to the rotational direction of the first belt 21 so as to contact the first belt at a position above the heat sink 30 with respect to the direction of gravitation. The scraper 70 is, for example, a film-like sheet member formed of, for example, a 0.1 mm-thick PET sheet in a length such that the scraper 70 the first belt 21 over at least a range in which the recording material S passes with respect to the widthwise direction of the first belt 21. The scraper 70 is disposed so as to contact the first belt 21 from a counterdirection to the rotational direction of the first belt 21. Such a scraper 70 has flexibility, so that the scraper 70 is capable of maintaining a state of contact with the first belt 21 while following motion of the first belt 21 which moves (rotates).

The scraper 70 is provided so as to be capable of cleaning the first belt 21 by removing, from the first belt 21, abrasion powder (called also abraded powder) deposited on the first belt 21. That is, as described above, the heat sink 30 contacts the inner peripheral surface of the first belt 21, so that the inner peripheral surface of the first belt 21 is rubbed against the heat sink 30 with rotation of the first belt 21. Then, the first belt 21 is abraded by the heat sink 30, so that the abrasion powder (abraded powder) can generate. This above-described is deposited on and carried on the first belt 21, and is liable to stagnate (accumulate) at an upstream end of the heat sink 30. Then, when an amount of the stagnated abrasion powder increases, a part of the stagnated abrasion powder enters between the heat sink 30 and the first belt 21, whereby a heat resistance increases and such a deposited matter is capable of lowering a cooling performance of the recording material S.

In order to suppress the generation of the above-described abrasion powder of the belt, as the first belt 21, for example, a belt formed of polyimide resin containing a polytetrafluoroethylene (PTFE) filler is used. A content of the PTFE filler is, for example, about 5% in terms of weight percentage. When the PTFE filler is contained in the polyimide resin which is a base material, a friction resistance with the heat sink 30 lowers, so that the first belt 21 containing the PTFE filler is not readily abraded by the heat sink 30 compared with the case where the PTFE filler is not contained in the first belt 21. However, even when the belt containing the PTFE filler is used, the abrasion powder of the belt can inevitably generate. This abrasion powder contains the PTFE filler, and therefore, does not readily deposit on the first belt 21, but even such abrasion powder can deposit on the first belt 21 when the abrasion powder passes through a sliding surface between the heat sink 30 and the first belt 21. Therefore, with a longer operation (use) time of the first belt 21, an amount of the deposited matter containing the abrasion powder stagnating at the upstream end of the heat sink becomes larger. Therefore, in order to remove the deposited matter, depositing on the first belt 21, from the first belt 21, as described above, the scraper 70 is disposed downstream of the heat sink 30 with respect to the rotational direction of the first belt 21.

Under the scraper 70 with respect to the direction of gravitation, the collecting box 71 for collecting and storing the abrasion powder scraped off from the inner peripheral surface of the first belt 21 by the scraper 70 is provided. The collecting box 71 opens upward with respect to the direction of gravitation, and is disposed so that the abrasion powder can be received through an opening thereof even on a side upstream of the first belt 21 with respect to the rotational direction than a contact portion between the scraper 70 and the first belt 21 is. Incidentally, the scraper 70 is fixed to the collecting box 71 with, for example, a double-side tape or the like.

The above-described first belt 21 is worn by being abraded by the heat sink 30 as described above, and can deteriorate with time. Further, the second belt 25 provided with no heat sink 30 is slowly worn compared with the first belt 21 but is worn with use, and an deteriorate with time. Therefore, in this embodiment, an operator is permitted to exchange the first belt 21 and/or the second belt 25. Specifically, the first belt 21 and the second belt 25 are provided so as to be capable of being inserted into and extracted from an upper frame 62 and a lower frame 63 (FIG. 6A, FIG. 6B), respectively of the recording material cooling device 20 with respect to the rotational axis direction of the first belt stretching rollers 22*a* to 22*d*. However, when the operator exchanges the first belt 21 and/or the second belt 25, in a contact state in which the first belt 21 and the second belt 25 are in contact with each other, the belt is not readily inserted into and extracted from the associated frame. Therefore, the first belt 21 and the second belt 25 are provided so as to be movable relative to each other in a manner such that these belts can be changed in state between the contact state and a separated (spaced) state in which the first belt 21 and the second belt 25 are separated (spaced) from each other.

<Contact-and-Separation Mechanism>

Figure 6A:
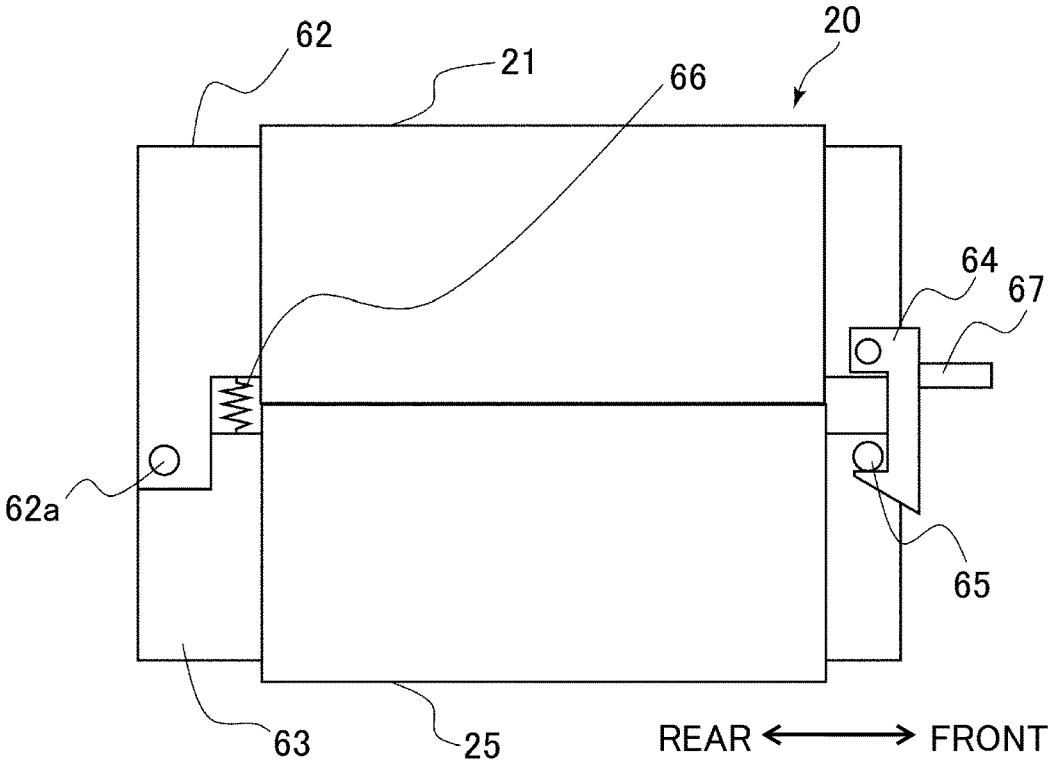
FIG. 6A is a schematic view showing a contact state of a belt.
Figure 6B:
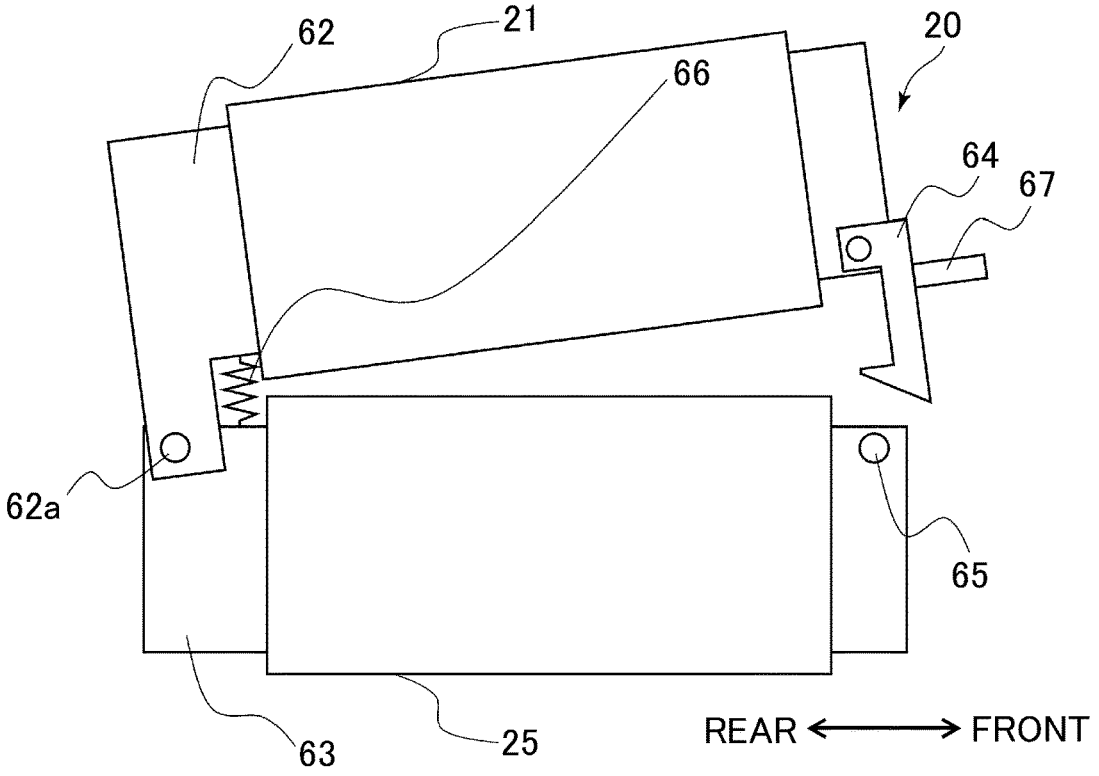
FIG. 6B is a schematic view showing a separated state of the belt.

A mechanism for moving the first belt 21 and the second belt 25 relative to each other (this mechanism is referred to as a contact-and-separation mechanism) will be described. FIGS. 6A and 6B are schematic views of the recording material cooling device 20 seen from a downstream side in the recording material feeding direction. Here, a left-right direction in FIG. 4 is the rotational axis direction of the first belt stretching rollers 22*a* to 22*d*, and a front-rear direction in FIG. 4 is the feeding direction of the recording material. Incidentally, in this embodiment, an example in which the upper frame 62 is swung upward relative to the lower frame 63 with respect to the direction of gravitation on one end side with respect to the widthwise direction is described, but the present invention is not limited thereto. The lower frame 63 may also be swung downward relative to the upper frame 62 with respect to the direction of gravitation on one end side with respect to the widthwise direction. In this embodiment, the contact-and-separation mechanism (contact-separation means) is principally constituted by a hooking member 64, a pin 65 and a compression spring 66 which are described later.

As shown in FIGS. 6A and 6B, the recording material cooling device 20 in this embodiment is roughly divided into the upper frame 62 and the lower frame 63. In these figures, the right side is a front side of the image forming apparatus 100 (recording material cooling device 20), and the left side is a rear side of the image forming apparatus 100 (recording material cooling device 20). The upper frame 62 holds the above-described first belt stretching rollers 22*a* to 22*d* so as to be rotatable, and holds the heat sink 30, the scraper 70 and the belt stretching mechanism portion 61 described later. On the other hand, the lower frame 63 holds the above-described second belt stretching rollers 26*a* to 26*d* and pressing rollers 26*e* and 26*f*. These upper frame 62 and lower frame 63 are connected to each other so as to be swingable about the swing shaft 62*a* provided on one end side (rear side) with respect to the widthwise direction. The first belt 21 is provided so as to be capable of being inserted into and extracted from the upper frame 62 from one end side with respect to the widthwise direction, and the second belt 25 is provided so as to be capable of being inserted into and extracted from the lower frame 63 from one end side with respect to the widthwise direction (right side in FIG. 6B).

On the one end side (front side) of the upper frame 62 with respect to the widthwise direction, the hooking member 64 is provided, and on one end side of the lower frame 63 with respect to the widthwise direction, the pin 65 is provided. On the other end side of the lower frame 63 with respect to the widthwise direction, the compression spring 66 for urging the upper frame 62 upward with respect to the direction of gravitation is disposed. Further, the hooking member 64 is provided with a grip portion 67, and the operator is capable of engaging the hooking member 64 with the pin 65 and is capable of disengaging the hooking member 64 from the pin 65 by rotating the hooking member 64 while gripping the grip portion 67 from the front side of the recording material cooling device 20. As shown in FIG. 6A, the hooking member 64 is engaged with the pin 65, so that the contact state in which the first belt 21 and the second belt 25 are in contact with each other is formed. The operator engages the hooking member 64 with the pin 65 by pressing the upper frame 62 toward the lower frame 63 against a spring force of the compression spring 66.

In the case where the operator exchanges the first belt 21 or the second belt 25, the operator release engagement between the hooking member 64 and the pin 65. When the engagement between the hooking member 64 and the pin 65 is released, as shown in FIG. 6B, the upper frame 62 is swung so as to be raised by the compression spring 66. At this time, the first belt stretching rollers 22*a* to 22*d*, the first belt 21, the heat sink 30, the scraper 70 and the belt stretching mechanism portion 61 are moved integrally with the upper frame 62. Then, the swing of the upper frame 62 is stopped by a stopper (not shown), and the upper frame 62 is positioned in a predetermined position. Thus, the upper frame 62 is swung relative to the lower frame 63, so that the first belt 21 and the second belt 25 are put in the separated state. Incidentally, a spring force of the compression spring 66 may only be required to be set at a value depending on a weight of the upper frame 62, and in the case of this embodiment, the spring force is set at a value at which the operator is capable of engaging the hook member 64 with the pin 65 by a force of about 10 N.

Returning to FIG. 3, in the recording material cooling device 20, as described above, the first belt 21 is stretched by the plurality of first belt stretching rollers 22*a* to 22*d*, and therefore, the first belt 21 is contacted to the heat sink 30 with predetermined pressure. Further, the scraper 70 having flexibility, such as a PET sheet is contacted to the first belt 21. In the conventional case, as already described above, during exchange of the first belt 21, the operator has to pull out the old belt while sliding the old belt on the heat sink 30 and the first belt stretching rollers 22*a* to 22*d*, and then stretches a new belt around the first belt stretching rollers 22*a* to 22*d* while sliding the new belt on the heat sink 30. Therefore, a resistance exerted on the belt by a slide of the belt on the heat sink 30 and the first belt stretching rollers 22*a* to 22*d* was large, so that it was difficult to exchange the belt. Specifically, it taken time and trouble that the first belt 21 is mounted at a proper position in a proper state and that the scraper 70 is properly contacted to the first belt 21.

Therefore, in the recording material cooling device 20 of this embodiment, in order to facilitate the belt exchange, the belt stretching mechanism portion 61 is provided. Incidentally, as described later, the belt stretching mechanism portion 61 is operated by the operator, but the operator cannot operate the belt stretching mechanism portion 61 when the first belt 21 and the second belt 25 are in the separated state (FIG. 6B).

<Belt Stretching Mechanism Portion>

The belt stretching mechanism portion 61 will be described. The belt stretching mechanism portion 61 as a moving means is a mechanism for moving the roller 22*b* (steering roller in this embodiment) between a stretch position (first position, FIG. 3) where the first belt 21 is stretched and a non-stretch position (second position, FIG. 7) where the first belt 21 is loosen. In the case where the roller 22*b* is in the second position, contact pressure to the first belt 21 is smaller than in the case where the roller 22*b* is in the first position, so that a degree of the stretch of the first belt 21 is alleviated. That is, a length of a phantom line connecting rotation centers of the respective first belt stretching rollers 22*a* to 22*d* in the case where the roller 22*b* is in the second position is shorter than a peripheral length of the first belt 21. Incidentally, the first position is a position where the first belt 21 is rotated (operated) by the first belt stretching rollers 22*a* to 22*d* and is also a position where the recording material is capable of being fed by the first belt 21 and the second belt 25.

Here, in the case where the roller 22*b* is not the steering roller but is a so-called tension roller for stretching the first belt 21 with predetermined tension by a compression spring, in order to move the roller 22*b* between the stretch position and the non-stretch position, only the roller 22*b* may be moved. That is, when the roller 22*b* is moved from the stretch position to the non-stretch position, the roller 22 may only be required to be moved against an urging force of the compression spring. On the other hand, in the case where the roller 22*b* is the steering roller, a mechanism for swinging the roller 22*b* is provided, so that in order to move the roller 22*b* between the stretch position and the non-stretch position, the roller 22*b* is moved together with the roller supporting mechanism 81. By this constitution, compared with the case where the roller 22*b* is moved against the urging force of the compression spring, a movement amount of the roller 22*b* can be increased, and therefore, the above-described operativity during the belt exchange by the operator can be improved.

Figure 8:
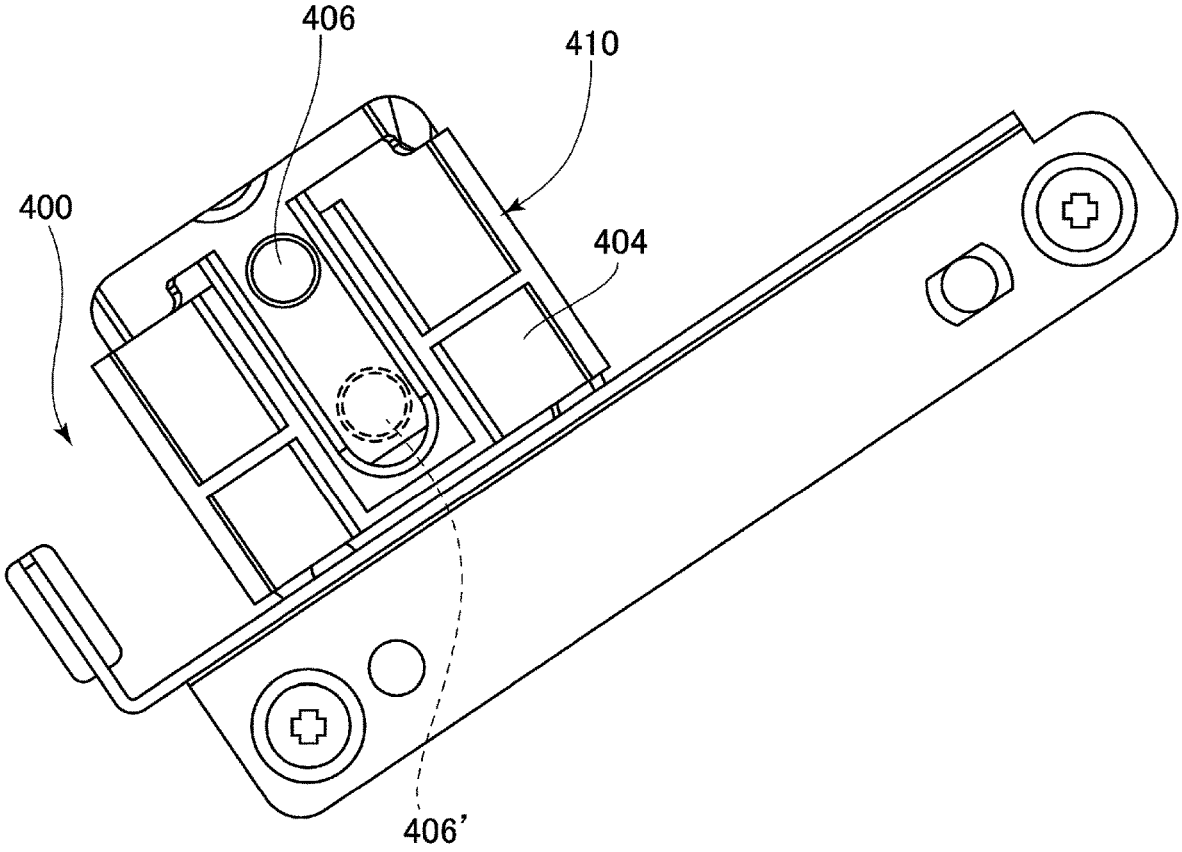
FIG. 8 is a schematic view for illustrating movement of a roller by the steering mechanism.
Figure 9:
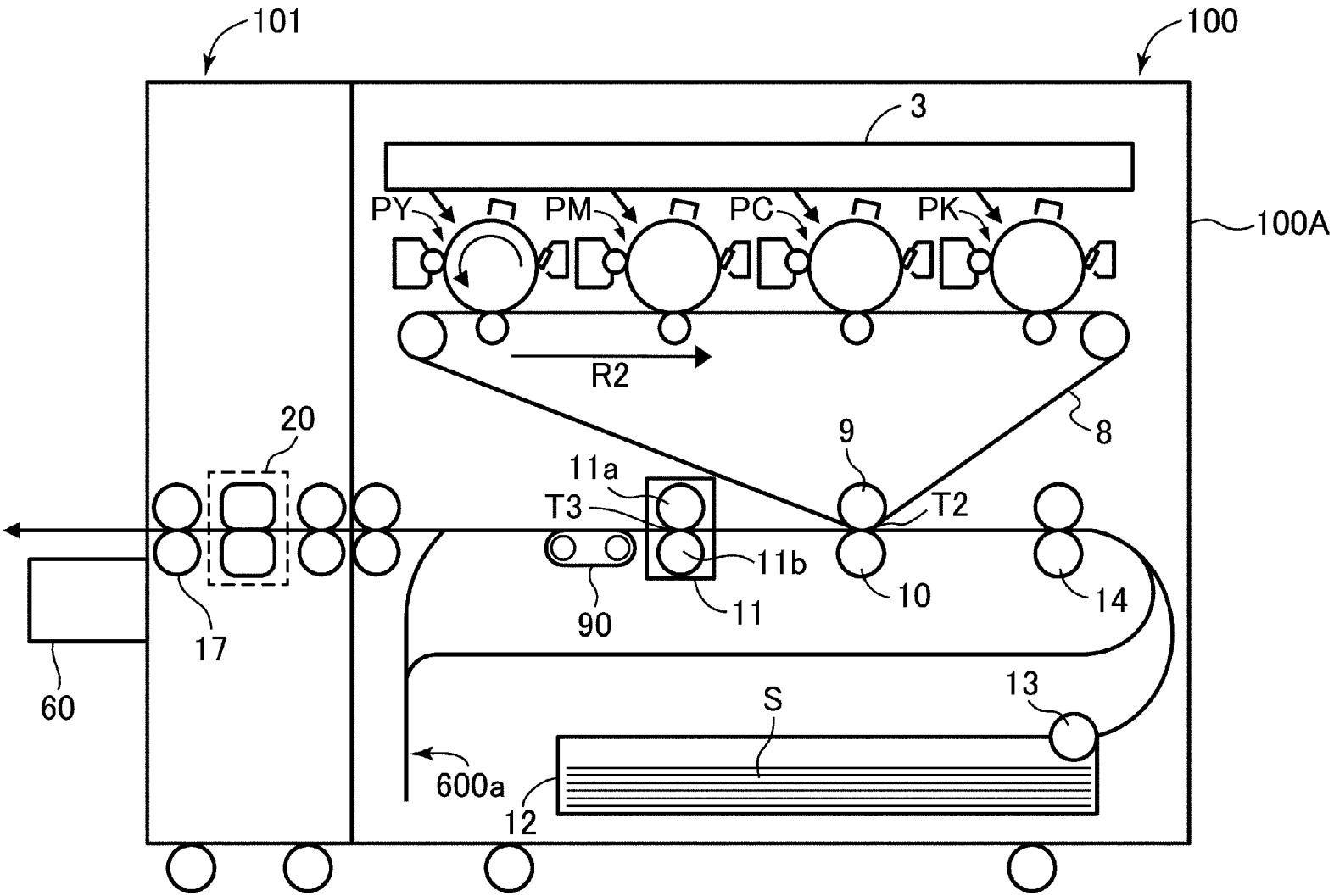
FIG. 9 is a schematic view showing an embodiment in which a recording material cooling device is provided outside an image forming apparatus.

In FIG. 8, a position (indicated by a solid line) of the steering operation shaft 406 when the roller 22*b* is positioned in the stretch position of the first belt 21 and a position (indicated by a broken line) of a steering operation shaft 406' when the roller 22*b* is positioned in the non-stretch position of the first belt 21 were shown. The movement direction of the steering operation shaft 406 during the steering control is a direction crossing the direction in which the roller 22*b* moves between the stretch position and the non-stretch position. The movement direction of the steering operation shaft 406 during the steering control is a direction perpendicular to the direction in which the roller 22*b* moves between the stretch position and the non-stretch position and to the rotational axis direction of the roller 22*b*. The steering operation shaft 406 moves along a groove formed in a U-shape of the fork plate 404 of the drive conversion portion 410. By employing such a constitution, when the roller 22*b* is moved between the stretch position and the non-stretch position, the roller 22*b* can be moved together with the roller supporting mechanism 81.

Figure 7:
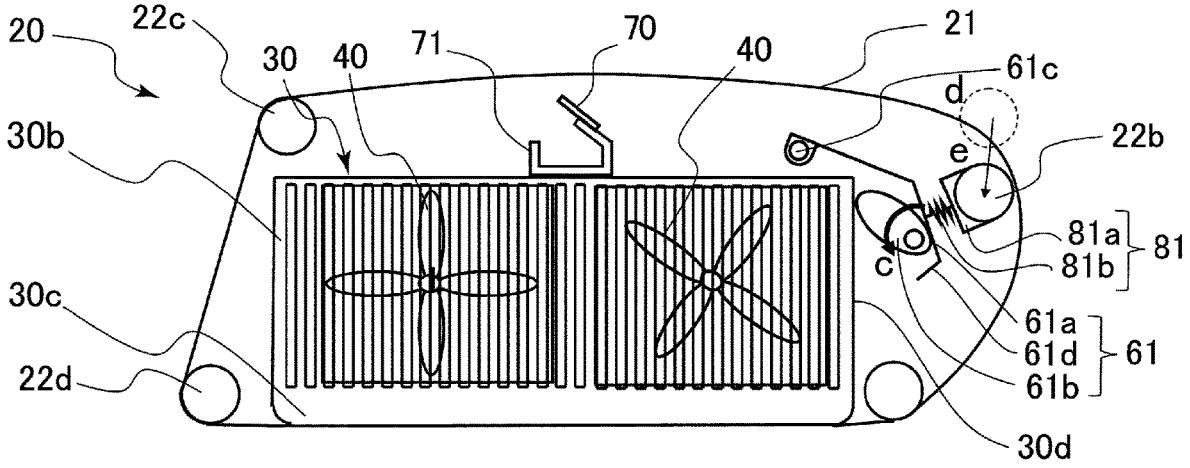
FIG. 7 is a schematic view for illustrating a belt stretching mechanism portion.

As shown in FIGS. 3 and 7, the belt stretching mechanism portion 61 includes a holding member 61*a* for holding the roller supporting mechanism 81 and a cam portion 61*b* formed in an elliptical shape, for example. The holding member 61*a* is provided so as to be swingable about a swing shaft 61*c* of the upper frame 62 (FIG. 6A). Further, the cam portion 61*b* is provided so as to rotatable relative to the upper frame 62. The cam portion 61*b* is operated by the operator, whereby the cam portion 61*b* is rotated so as to reciprocate between the position shown in FIG. 3 and the position shown in FIG. 7. Then, by the rotation of the cam portion 61*b*, the holding member 61*a* is swung. Depending on the direction of the rotation of this cam portion 61*a* by the operator, the roller 22*b* moves in a direction (inward direction of the belt) approaching the heat sink 30 and in a direction (outward direction of the belt) away from the heat sink 30. Thus, the roller 22*b* is movable between the stretch position (FIG. 3) in which the first belt 21 is stretched by the first belt stretching rollers 22*a* to 22*d* and the non-stretch position (FIG. 7) in which the first belt 21 is loosen without being stretched by the first belt stretching rollers 22*a* to 22*d*.

In the case where the roller 22*b* is in the stretch position, the scraper 70 contacts the first belt 21, and the first belt 21 is in the state in which the first belt 21 contacts the heat sink 30 with predetermined pressure. In that state, tension of the first belt 21 is about 39.2 N (about 4 kgf). On the other hand, in the case where the roller 22*b* is in the non-stretch position, the first belt 21 is loosen relative to the first belt stretching rollers 22*a* to 22*d*. When the first belt 21 is in a loosened state, the operator is capable of preventing the scraper 70 and the heat sink 30 from contacting the first belt 21. That is, during the exchange of the first belt 21, the operator is capable of dismounting the old belt from the upper frame 62 without contacting the scraper 70 and the heat sink 30. That is, the operator can remove the old belt with no load. Then, the operator is capable of mounting a new belt in the upper frame 62 so as to be stretched around the first belt stretching rollers 22*a* to 22*d* without being contacted to the scraper 70 and without being slid on the heat sink 30. Thus, by moving the roller 22*b* from the stretch position to the non-stretch position during the belt exchange, it is possible to improve the operativity during the belt exchange.

By using FIG. 7, a specific operation of the belt stretching mechanism portion 61 will be described. As shown in FIG. 7, the operator rotates the cam portion 61*b* counter clockwise (arrow c direction in the figure) by holding an unshown knob, so that the holding member 61*a* moved downward while contacting the cam portion 61*b* by a self-weight thereof with the swing shaft 61*c* as a swing center. In the case of this embodiment, a side surface 30*d* of the heat sink 30 functions as a stopper of the cam portion 61*b*, so that rotation of the cam portion 61*b* stops at the side surface 30*d*. Thus, the roller 22*b* moved from a stretch position d to a non-stretch position e.

The position of the roller 22*b* in the non-stretch position e is located inside than the position of the roller 22*b* in the stretch position d is, i.e., it is called a position close to the heat sink 30. Further, the position of the roller 22*b* in the non-stretch position e is, compared with the stretch position d, a position where the roller 22*b* is close to at least either one of the rollers 22*a*, 22*c* and 22*d*. For that purpose, inclusive of the swing shaft 61*c*, the holding member 61*a* and the cam portion 61*b* are provided in the upper frame 62 (FIG. 6A). The roller 22*b* moves to the non-stretch position e and thus moves away from the first belt 21, whereby tension of the first belt 21 is released and thus exchange of the first belt 21 by drawing the first belt 21 is enabled. By this, the operator is capable of easily pulling out the old first belt 21 which is an object to be exchanged, so that there is no liability that the scraper 70 is damaged or deformed and thus the operator can easily exchange the first belt 21. Further, when the operator mounts a new first belt 21, the operator is capable of mounting the belt without causing the belt to slide on the scraper 70 and the heat sink 30 and the like, and therefore, the operator is capable of easily exchanging the first belt 21 without damaging the first belt 21.

After the operator mounts the new belt in the upper frame 62, the operator rotates the cam portion 61*b* clockwise. Then, the holding member 61*a* moves upward so as to be raised by the cam portion 61*b* with the swing shaft 61*c* as the swing center. Then, the cam portion 61*b* contacts a stopper portion 61*d* formed on a side opposite from the swing shaft 61*c*, whereby the rotation of the cam portion 61*b* stops. Thus, the roller 22*b* is moved from the non-stretch position e to the stretch position d.

Incidentally, in the case where the roller 22*b* is not in the stretch position d, the operator cannot press downward the upper frame 62 toward the lower frame 63, so that it is preferable that the first belt 21 and the second belt 25 cannot be put in the contact state.

As described above, in this embodiment, the first belt 21 in the stretched state is loosened with movement of the roller 22*b* (non-stretched state). The operator can easily loosen the first belt 21, so that when the operator exchanges the first belt 21, the first belt 21 can be inserted into and extracted from the recording material cooling device 20 without contacting the heat sink 30 and the scraper 70. That is, during the exchange of the first belt 21, the old first belt 21 which is the object to be exchanged can be easily removed (extracted) and the heat sink 30 can be made hard to contact the new first belt 21, so that it is possible to suppress occurrence of scars on the first belt 21 by contact of the first belt 21 with the heat sink 30. Further, during the exchanges of the first belt 21, the scraper 70 can be made hard to contact the first belt 21, so that it is possible to suppress that the scraper 70 is turned upside down or broken by contact of the scraper 70 with the first belt 21. Thus, in the recording material cooling device 20 of the belt cooling type in which the heat sink 30 is contacted to the inner peripheral surface of the first belt 21 in order to cool the first belt 21, the operator can easily exchange the first belt 21.

Other Embodiments

In the above-described embodiment, the belt stretching mechanism portion 61 is not provided on the second belt 25 side where the heat sink 30 and the scraper 70 are not disposed, but may also be provided on the second belt 25 side.

In the above-described embodiment, the constitution in which when the first belt 21 is exchanged, the stretched state and the non-stretched state of the first belt 21 is switched to each other by the belt stretching mechanism portion 61 was described, but the present invention is not limited thereto. For example, a constitution in which the stretched state and the non-stretched state of the first belt 21 is switched to each other by the belt stretching mechanism portion 61 when the scraper 70 is exchanged without exchanging the first belt 21 or when the abrasion powder collected in the collecting box 71 is removed may also be employed. In the case where the constitution in which the stretched state of the first belt 21 is switched to the non-stretched state when the scraper 70 is exchanged or when the abrasion powder collected in the collecting box 71 is removed is employed, the upper frame 62 and the lower frame 63 may also be not separated from each other. In this case, an increase in exchange frequency of the first belt 21 due to abrasion of the inner peripheral surface of the first belt 21 when the scraper 70 and the collecting box 71 are inserted into and extracted from the recording material cooling device 20 can be suppressed by placing the first belt 21 in the non-stretched state.

In the above-described embodiment, the case where the recording material cooling device 20 was provided in the apparatus main assembly 100A of the image forming apparatus 100 was described as an example (FIG. 1), but the present invention is not limited thereto. For example, the recording material cooling device 20 may also be provided outside the apparatus main assembly 100A. FIG. 8 shows an example in which the recording material cooling device 20 is provided outside the apparatus main assembly 100A.

As shown in FIG. 8, to the apparatus main assembly 100A, an external cooling unit 101 as an external cooling device is connected. The external cooling unit 101 is constituted as one of peripheral devices (called option units or the like) capable of being retrofitted to the apparatus main assembly 100A in order to extend the function of the image forming apparatus 100, so as to be connectable to the image forming apparatus 100. The external cooling unit 101 is provided for lowering a temperature of the recording material S, high compared with the temperature before fixing, to a predetermined temperature by cooling the recording material S discharged from the apparatus main assembly 100A. The external cooling unit 101 includes the above-described recording material cooling device 20 for cooling the recording material S.

The recording material S cooled by the external cooling unit 101 is discharged from the external cooling unit 101 by a discharging roller pair 17 and is stacked on a stacking unit 60. The stacking unit 60 is provided so as to be mountable to and dismountable from the external cooling unit 101 or the image forming apparatus 100. That is, in the case where the external cooling unit 101 is not connected to the image forming apparatus 100, the stacking unit 60 is mounted to the image forming apparatus 100 (FIG. 1). Further, when the external cooling unit 101 is connected to the image forming apparatus 100, the stacking unit 60 is dismounted from the image forming apparatus 100 and then is mounted to the external cooling unit 101.

Incidentally, as the peripheral machine, a plurality of external cooling units 101 may also be connected. By increasing the number of external cooling units 101 to be connected, the operator is capable of easily improving cooling power of the recording material S in the already-installed image forming apparatus 100.

According to the present invention, in the recording material cooling device of the belt cooling type in which the cooling member is contacted to the inner peripheral surface of the endless belt in order to cool the recording material, the operator is capable of easily exchanging the belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2020-014115 filed on Jan. 30, 2020, and 2020-187428 filed on Nov. 10, 2020, which are hereby incorporated by reference herein in their entirety.

What is claimed is:

1. A recording material cooling device for cooling a recording material passed through a fixing device for fixing a toner image on the recording material by heating, said recording material cooling device comprising:

a belt;

a cooling unit configured to cool said belt in contact with an inner peripheral surface of said belt;

a first roller provided on the inner peripheral surface of said belt;

a second roller rotatably configured to stretch said belt in cooperation with said first roller;

a roller holder configured to rotatably hold said second roller;

a steering unit configured to move said belt in a rotational axis direction of said second roller by swinging said roller holder so that said second roller swings relative to said first roller;

an urging unit configured to urge said roller holder so that said second roller is urged toward the inner peripheral surface of said belt;

a holding unit configured to hold said urging unit, said urging unit urging said roller holder in a direction away from said holding unit; and a moving unit configured to move said holding unit between a first position for enabling rotation of said belt by stretching said belt by said first roller and said second roller and a second position for enabling exchange of said belt, said moving unit moving said holding unit together with said roller holder from the first position to the second position.

2. A recording material cooling device according to claim 1, further comprising a cleaning unit capable of cleaning said belt in contact with the inner peripheral surface of said belt, wherein said cleaning unit contacts the inner peripheral surface of said belt in a case in which said second roller is in the first position and does not contact the inner peripheral surface of the belt in a case in which the second roller is in the second position.

3. A recording material cooling device according to claim 1, wherein said holding unit includes:

a steering operation shaft provided in said roller holder and configured to be operated by said steering unit, and wherein said steering unit moves said steering operation shaft in a direction perpendicular to the rotational axis direction of said second roller and a movement direction of said second roller between the first position and the second position by said moving unit.

4. A recording material cooling device according to claim 1, further comprising:

a feeding unit contacting an outer peripheral surface of said belt and configured to form a nip in which the recording material on which the toner image is formed is fed; and a contact-and-separation unit capable of changing a state of said belt and said feeding unit between a state in which said belt and said feeding unit forms the nip and a state in which said belt and said feeding unit are in separation from each other, wherein said moving unit is capable of moving said holding unit in a state in which said belt and said feeding unit are separated from each other.

5. A recording material cooling device according to claim 4, wherein said feeding unit is an endless belt.

6. A recording material cooling device according to claim 1, wherein said cooling unit is a heat sink including a heat receiving portion configured to receive heat in contact with said belt and a heat dissipation portion configured to dissipate the heat received by said heat receiving portion.

7. A recording material cooling device according to claim 1, wherein a distance of said second roller from said first roller is shorter when said holding unit is in the first position than when said holding unit is in the second position.

8. A recording material cooling device according to claim 1, further comprising other rollers configured to stretch said belt in cooperation with said first roller and said second roller, wherein when said holding unit is in the second position, a length of a phantom line connecting a rotation center of said first roller, a rotation center of said second roller and rotation centers of said other rollers is shorter than a peripheral length of said belt.

9. An image forming apparatus comprising:

an image forming unit configured to form a toner image on a recording material;

a fixing device configured to fix the toner image, formed by said image forming unit, by heating; and a recording material cooling device according to claim 1, which is provided on a side downstream of said fixing device with respect to a recording material feeding direction and which is configured to cool the recording material passed through said fixing device.

10. A recording material cooling device according to claim 1, wherein said moving unit includes a supporting portion configured to support said holding unit at the first position, and wherein said holding unit moves from the first position to the second position by a self-weight thereof by support of said supporting portion being released.

11. A recording material cooling device according to claim 1, wherein said moving unit includes a rotatable cam portion contacting said holding unit, and a swing shaft configured to swingably support said holding unit between the first position and the second position with rotation of said cam portion.

* * * * *